United States Patent [19]

Jacobs

[11] Patent Number: 4,887,979

[45] Date of Patent: Dec. 19, 1989

[54] WATER-PROOF OUTDOOR TAP WITH IMPROVED WATERPROOF CONNECTOR

[75] Inventor: Leon D. Jacobs, Hicksville, N.Y.

[73] Assignee: North American Philips Corporation, New York, N.Y.

[21] Appl. No.: 199,642

[22] Filed: May 27, 1988

[51] Int. Cl.[4] ..... H01R 13/73

[52] U.S. Cl. ..... 439/578

[58] Field of Search ..... 439/271, 578–585

[56] References Cited

U.S. PATENT DOCUMENTS 4,713,024 12/1987 Hatakeyama et al. ..... 439/581

4,714,432 12/1987 Huggins ..... 439/578

*Primary Examiner*—Joseph H. McGlynn

*Attorney, Agent, or Firm*—Michael E. Marion

[57] ABSTRACT

A water-proof outdoor tap distributor of cable TV network system electrical signals wherein the electro-pin of a tap connector is designed with two different size sheets, a shorter one being assembled in the middle of a longer one and the longer one being stretched up to the end side as a transmission point; the exposed electro-pin of the connector being covered by a super design glue and every connector being also covered with a second glue to prevent water leaks into the inside of the PCB and internal cavity.

1 Claim, 2 Drawing Sheets

WATER-PROOF OUTDOOR TAP WITH IMPROVED WATERPROOF CONNECTOR

BACKGROUND OF THE INVENTION

Current outdoor taps used in general CATV-/MATV, cable TV applications are not perfectly water-proof under environmental conditions and due to water entering the taps through subscriber ports, electrical shorts, or degradation of performance of the outdoor tap results and the signal is untransmittable to the end user.

All the general cable TV network systems use outdoor taps which are constructed as shown FIG. (1). An input 11 and an output 12 are connected with the cable wire to transmit the signal to the end user.

Networks on the inside of the taps including the printed circuit board (PCB) of tap units distribute and transmit the signal equivalently through each connector (13), then through cable wire to the end user.

However the general outdoor tap is not perfect. Internal corrosion and degradation of electrical performance due to water entering the tap causes unnecessary defects in the product. Outdoor taps are used outside of the house. The inside of the tap is composed of components sensitive to moisture. When water penetrates the units corrosion and electrical shorts occur. The units fail to operate within specification limits because the generally used outdoor tap is not 100% water-proof due to the exposed areas—including portions of currently used connectors and electrode pins which are not 100% water-proof.

SUMMARY OF THE INVENTION

The instant invention improves, the existing outdoor taps by the new design of a "sealed type" connector for use in the outdoor tap that prevents water leakage into electrical areas through the "F port" or from the connector hole. Additionally we have designed a certain water-proof glue process that covers every possible leakage path which prevents water from leaking into the inside of the unit.

The present invention relates to water-proof outdoor taps used by cable TV network systems to distribute electrical signals having connectors configured with two different sized sheets where one of the sheets forms the exposed electro-pin of the connector and is covered by a super design glue. Every connector is also covered with glue to prevent water leaks into the inside PCB and internal cavity.

DETAILED DESCRIPTION OF THE PREFERRED EMBODIMENT

Figure 1:
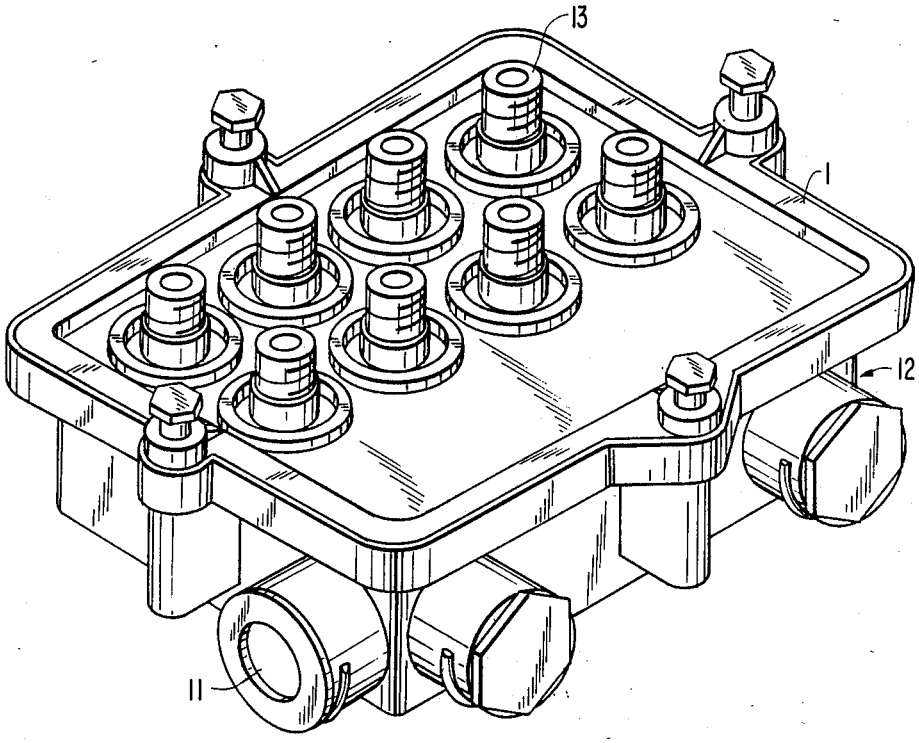
FIG. 1 illustrates general outdoor taps units.

In the prior art F-port connectors electro-pin (64) has traditionally been constructed from a single piece of flat sheet metal. The sheet metal is cut such that the right half (61) and left half (62) are mirror images of each other. This single piece is then folded down its center line to form the finished F-Port center pin (64). The center conductor of the coaxial cable then mates to the spring contacts (64) through an opening in the bottom of the external shell. As a result of this construction, moisture also has the ability to enter the multi-tap and corrupt the device. Moisture can enter the external shell (65) of the F-Port cavity (63) and around the center contacts (64). One in this cavity (63), the moisture will wick up between the halves (61 and 62) of the center contact to the PCB and other moisture sensitive components. Past designs have tried to fill the area at the top of the insulator with a potting compound to stop moisture migration but have not been successful in sealing the area between the contact halves (61 and 62). Other attempts used machined, cylindrical contacts but were not cost effective.

Figure 2:
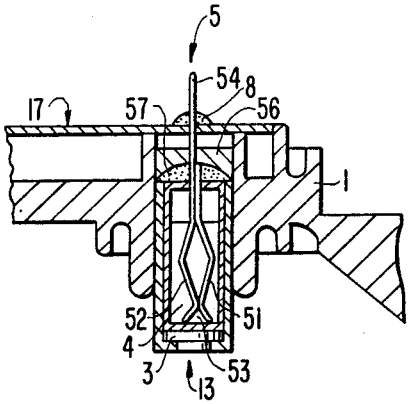
FIG. 2 illustrates a water-proof connector embodying the present invention.
Figure 3:
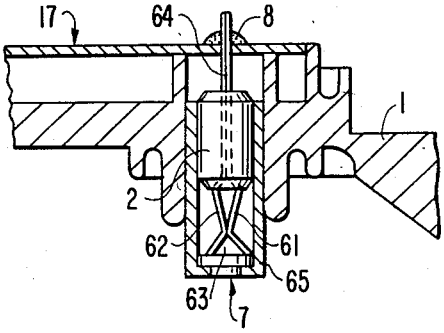
FIG. 3 PRIOR ART
FIG. 3 shows a prior art connector.

As shown in FIG. 2, the difference between the construction of the present invention and the conventional type is in the fixed tube (4) and electro-pin (5) sections. As shown, a longer fixed tube (4) covers the open area of the electro-pin to prevent water leakage in and a longer half sheet 52 stretches up to the end side as a signal transmission point 54. This invention begins with the traditional single piece of sheet metal, but instead of stamping the right and left halves as mirror images (61 and 62), the halves are stamped differently (51 and 52). This difference, one half shorter than the other, now allows for epoxy potting compounds (56 and 57) to completely stop moisture migration.

The connector (13) is covered with proper epoxy (56) and assembled into the tap units. With the super fix glue (57) and water-lead glue (56) together it prevents the water-leak problem and upgrades efficiency of units.

I claim:

1. A waterproof outdoor tap distributor of electrical signals comprising a connector having an electro-pin formed by a single piece of metal formed into two sheets folded to face and press against each other and disposed within a fixed tube in said connector, said electro-pin having a first end portion forming an internal cavity for said connector and an opposite end portion forming a signal transmission point, characterized in that said sheets have unequal sizes, the first sheet being approximately half as long as the second sheet, said second sheet having a portion emerging from said fixed tube so as to form said signal transmission point and said first sheet being substantially disposed within said fixed tube and having an end portion covered with at least one type of waterproof compound so as to block the passage of liquids from said internal cavity to said transmission point.

* * * * *